United States Patent [19]

Headen et al.

[11] 4,225,085

[45] Sep. 30, 1980

[54] SHOWER HEAD DISPENSER

[75] Inventors: James J. Headen, 1602 216th Ave. SE., Issaquah, Wash. 98027; Warren D. Abbott, Jr., 9964 Tanglevine, Dallas, Tex. 75238; Clifton G. Hampton, Euless, Tex.

[73] Assignees: James J. Headen, Issaquah, Wash.; Warren D. Abbott, Jr., Dallas, Tex.

[21] Appl. No.: 24,883

[22] Filed: Mar. 29, 1979

[51] Int. Cl.[3] ..... B05B 7/30

[52] U.S. Cl. ..... 239/317; 239/73; 239/354; 239/365; 239/582; 222/162

[58] Field of Search ..... 239/71–74, 239/272, 310, 317, 318, 364–367, 581, 582, 354; 222/162, 521, 630; 422/266, 283

[56] References Cited

U.S. PATENT DOCUMENTS

| | | | |
|---|---|---|---|
| 811,749 | 2/1906 | Somers | 239/73 |
| 1,904,739 | 4/1933 | Kroen | 222/521 |
| 2,164,004 | 6/1939 | Wright | 222/521 X |
| 2,536,361 | 1/1951 | Flanders | 239/71 X |
| 3,081,004 | 3/1963 | Laughlin et al. | 222/162 X |
| 3,658,091 | 4/1972 | Buzzi | 239/318 X |
| 3,791,410 | 2/1974 | Sadiano | 239/318 X |
| 4,121,773 | 10/1978 | Headen et al. | 239/317 |

*Primary Examiner*—Robert W. Saifer

*Attorney, Agent, or Firm*—Thomas L. Cantrell; Joseph H. Schley

[57] ABSTRACT

Disclosed is a shower head dispenser for bath oil and the like which includes a body member with an axial bore adapted for insertion between a shower line and a shower head. The body member has two longitudinally spaced apertures or transverse bores in its side wall which communicate between the axial bore and a detachable oil container. It has a dam extending transversely across the bore. One of the apertures intercepts the axial bore at the crest of the dam, and the other aperture intercepts the axial bore upstream of the dam. The oil container has an integral valve stem thereon which seats in the end of the downstream transverse bore, and metering is achieved by rotation of the container. When water passes through the axial bore of the body member, the greater pressure at the upstream bore or aperture forces oil out of the container through the downstream bore or aperture into the axial bore at the dam, where it mixes with water enroute to the shower head.

17 Claims, 6 Drawing Figures

SHOWER HEAD DISPENSER

BACKGROUND OF THE INVENTION

Bath oil and similar skin conditioners are water soluble or water dispersible materials of fairly high viscosity which have been traditionally added in small quantities to bath water. It has been proposed in the past to mix bath oil with water passing through a shower head by aspirating it into the shower line at a point upstream of the head. Such systems have not found wide acceptance because they are extremely sensitive to water flow rate, since they rely on the differential between atmospheric pressure and the pressure of the flowing water at the point of aspiration, and this differential is quite small at low flow rates. In addition, the line constriction required to produce good aspiration objectionably limits the maximum delivery rate of the shower line. Furthermore, the small lines involved in aspiration systems are prone to clogging.

An improvement over aspirated systems is the positive displacement device shown in Headen et al. U.S. Pat. No. 4,121,773, and in part in the prior art cited therein, namely: McPherson U.S. Pat. No. 2,058,901; Brunner U.S. Pat. No. 2,235,278; McNair et al U.S. Pat. No. 3,132,806; Hubert U.S. Pat. No. 3,194,444; James U.S. Pat. No. 3,764,074 and Lemond U.S. Pat. No. 3,847,354. But even with such systems, extreme care is required in metering, inasmuch as very small changes in area through the metering valve cause significant changes in the length of time consumed in dispensing a single containerfull of bath oil. (Generally, the dispensing should occupy about a minute, to allow for convenient even distribution over the body. Dispensing times of only a few seconds do not allow this, while long dispensing times cause impatience and waste hot water.)

SUMMARY OF THE INVENTION

In accordance with the present invention, a positive displacement system is provided for introducing bath oil into a shower line just upstream of the shower head. Although the invention is primarily intended for use with bath oil, shampoo, soap, rinses, and the like may also be dispensed by it. The bath oil, etc., is preferably a liquid, but may be a gel or solid. The dispenser of the invention introduces oil into the water flowing through the shower line reliably, substantially independently of flow rate or low line pressure. The passages through which the oil flows in the device are of substantial diameter, and are not prone to clogging. In addition, the device is self-flushing after use, and may be flushed in several manners to prevent oil build-up leading to clogging. Accurate and convenient metering is provided.

The dispenser of the invention, in its preferred form, includes a body member having an axial bore therethrough. The body member is adapted to be inserted between a shower line and shower head, and is provided with threaded end portions for this purpose. In a side wall of the body member, preferably at the bottom of the member as it is oriented in ordinary installation, are provided two longitudinally spaced apertures or transverse bores, which may conveniently be designated "upstream" and "downstream" by reference to their relative positions on the body member. The apertures, in addition to being spaced, are preferably aligned with each other longitudinally, that is, parallel to the axis of the axial bore. These apertures provide communication between the axial bore and the exterior of the body member.

On the outside of the body member, the apertures or transverse bores are surrounded or encircled by fitting means, such as a threaded socket. A detachable oil container, with mating attachment means, such as a threaded neck or rim, is adapted for connection to the body member at the fitting means. Preferably the oil container is sized to accommodate sufficient bath oil for at least a single application.

A transverse dam is provided within the axial bore of the body member. The dam is sized and shaped to create the desired pressure conditions (discussed below) in the water flowing through the unit, while at the same time permitting water delivery rates to the shower head which are satisfactory.

One of the above mentioned transverse bores intercepts the axial bore at the top or crest of the dam, and the other intercepts the axial bore at a selected point upstream of the dam.

The oil container has an integrally formed valve needle formed therein, axially of the container. It is aligned with the downstream transverse bore when the container is attached to the main body, and is adapted to seat in a valve seat provided at the lower extremity of the bore. Variation of the degree of valve opening is accomplished by rotating the oil container with respect to the main body member.

Preferably, a series of detents are provided on the interior wall of the oil container, around the circumference thereof near the top edge. Mounted on the body in position to engage the detents is a spring having fingers which "click" against the detents as the oil container is rotated on the body. In addition indica may be provided on the body and container. These features make for positiveness and reproducibility in valve settings.

In use, the oil container is first filled with a suitable amount of bath oil, and attached to the body member. At the point in a shower when it is desired to apply bath oil, the oil container is rotated to open the valve to the desired degree. The water pressure in the main axial bore at the point of interception of the upstream transverse bore is always greater than the water pressure at the crest of the dam, where the downstream transverse bore intercepts the axial bore. This is the case, no matter what the flow rate or absolute water pressure. As a consequence, water flows through the upstream bore and aperture into the oil container, where it picks up oil (or forces oil ahead of it) and flows through the downstream aperture and bore to rejoin the main stream of water at the axial throat. The oil-water mixture then flows through the shower head. This action continues until the oil supply is exhausted, or the oil container is rotated to turn the dispenser off.

From the foregoing it can be seen that a principal object of the present invention is the provision of an improved shower head bath oil dispenser which creates pressure conditions in the flowing water which are exploited to positively displace the oil into the water stream.

Other objects of the invention include the provision of a shower head dispenser which is easy to use, simple in construction, and safe and reliable in operation.

The manner in which the foregoing objects and purposes, together with other objects and purposes, are attained may best be understood from a consideration of the detailed description which follows, together with the accompanying drawings.

DESCRIPTION OF THE PREFERRED EMBODIMENTS

Figure 1:
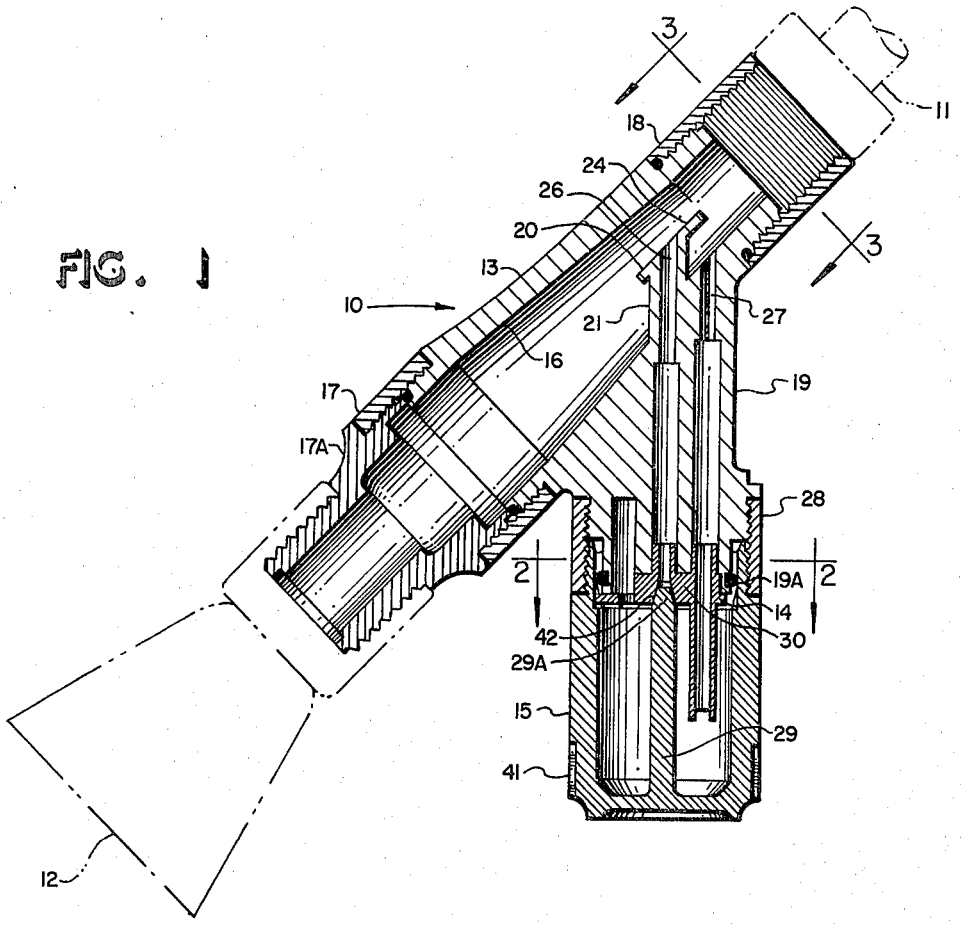
FIG. 1 is a cross-sectional side elevational view of a shower head dispenser constructed in accordance with the invention.
Figure 2:
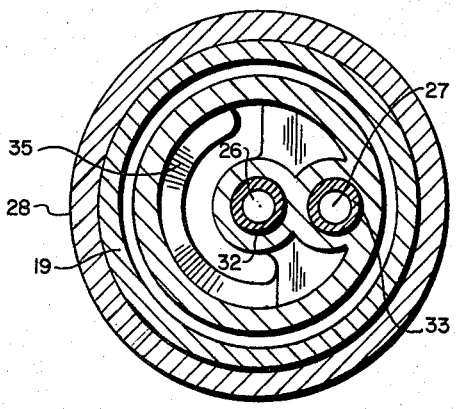
FIG. 2 is a cross-sectional view, on an enlarged scale, of the lower part of the main body and the upper part of the oil container, the section being taken on the line 2—2 of FIG. 1.
Figure 3:
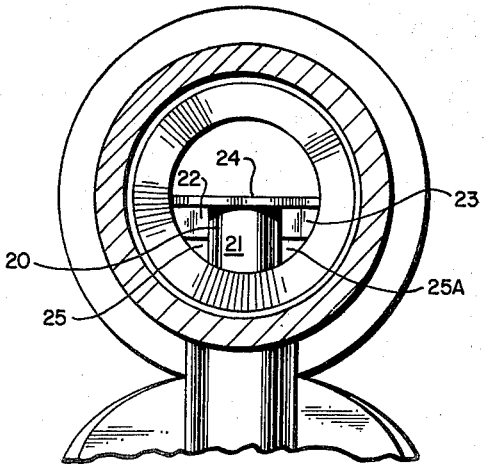
FIG. 3 is a fragmentary sectional view, on an enlarged scale, of the upper part of the main body, the section being taken on the line 3—3 of FIG. 1.
Figure 4:
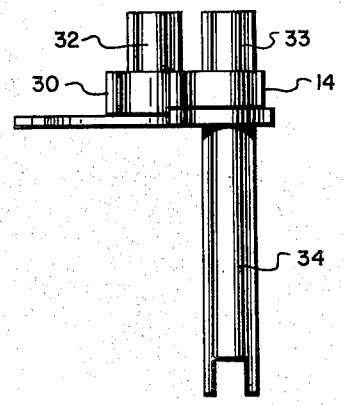
FIG. 4 is a side elevational view on an enlarged scale, of an insert containing the valve seat and spring.

In the drawings, the shower head bath oil dispenser of the invention is designated generally as 10. It is adapted for insertion into a shower line, and is thus shown in FIG. 1 as interposed between shower line pipe 11 and shower head 12. The dispenser 10 may be executed in plastic, metal, or partly in each, or made from any other suitable material. It is shown in FIG. 1 oriented approximately in its installed and in-use position, and references to "top" and "bottom" are made herein with relation to this position. As FIG. 1 is drawn, the flow of water through the device is from right to left, and in this description references are occasionally made to the relative location of parts of the device as "upstream" and "downstream" from one another.

The dispenser 10 comprises three main components: body member 13, having an axial bore therethrough; insert 14, mounted on the lower or bottom side of the body member; and oil container 15, also mounted on the lower or bottom side of the body member, and enclosing the insert.

The axial bore of body member 13 is designated 16, and is preferably of approximately the same diameter as shower line 11. At each end of bore 16 are mounted threaded adaptors 17, 17A and 18 for connecting the body member to the shower head 12 and shower line 11, respectively. Adaptors 17, 17A and 18 maybe be formed integrally with body member 13 if desired. Various forms of adaptors may be employed to accommodate different shower line and shower head connection systems, and provision may be made to include washer or O-rings adjacent the adaptors, or one of them, if their use is deemed appropriate. Two such O-rings are shown in the drawings.

The external shape of body member 13 is not critical, but in its preferred form it is generally cylindrical, with an oil container receiving projection 19 formed on its lower or bottom side extending at an angle of about 45° with the axis of the cylinder. In this way, assurance is obtained that oil container 15 may be held essentially upright as it is brought into contact with, and attached to, body member 13 when the latter is in its normal installed position, as shown in FIG. 1. The risk of spillage of bath oil during attachment of container 15 is thus greatly reduced.

In axial bore 16, dam 20 protrudes upwardly about one half the diameter of the bore. Dam 20 may be given various shapes; in the preferred embodiment, it comprises a central column 21, wing walls 22, 23, and crest flange 24, which protrudes upstream somewhat and downstream a short distance also. The wing walls are apertured as at 25, 25A, so the water on the upstream side of the dam will drain when the shower is turned off.

A pair of apertures or transverse bores 26, 27 are formed in the bottom side wall of body member 13. Apertures 26, 27 are longitudinally spaced and are also preferably longitudinally aligned on the body member, and are in any event positioned thereon so that aperture 27 is a spaced distance upstream from aperture 26. The apertures or transverse bores preferably terminate at the bottom surface of projection 19, where they are encircled or encompassed by fitting means 28, which is preferably a threaded member. Like adaptors 17, 18, fitting means 28 may be made integral with body member 13, if desired. Transverse bore 26 terminates at its upper end at the crest of dam 20, while transverse bore 27 terminates upstream of the dam. It should also be noted that transverse bore 26 terminates at its lower end in the center of projection 19.

Oil container 15 is detachably connected to body member 13, at the bottom of projection 19, by threads formed at its upper margin or rim. These threads are of shallow pitch. Preferably container 15 is formed of transparent or translucent material so that a user may observe the state of the oil supply therein. A needle type valve stem 29, having a tapered tip 29A extends from the floor of the container upwardly along the axis of the container. Detents or serrations 40 are arranged around the inner wall of container 15 near the upper edge thereof. The outer wall of the container is serrated at 41 near the bottom thereof to make it easier to grip and turn with a wet hand.

Insert 14 may be integrally formed with main body 13, if desired, but is preferably a separate piece formed of a material with good flexure and wear properties, such as nylon. It comprises a body portion 30, which fits into a congruently shaped recess in the lower end of projection 19; integral upstanding tubes 32 and 33, which fit into the lower ends of bores 26 and 27 respectively; downcomer 34, which is a downward extension of tube 33; and spring member 35. The spring is cantilevered outwardly from body portion 30, and is curved in plan view to follow the inner wall of container 15. At its end and at a point angularly offset from its end, projections or tabs 36 and 37 are provided on spring 35. These engage the detent serrations 40 on the oil container. As the container is turned or rotated with respect to main body 13, the tabs jump or "click" from detent to detent.

A downward projection 38 (seen best in FIG. 5), depending from the bottom of projection 19, fits between the tabs, the outer edge of spring 35, and the inner wall of container 15. It serves to reinforce spring 35 and reduce stresses thereon during turning of the container.

Figure 6:
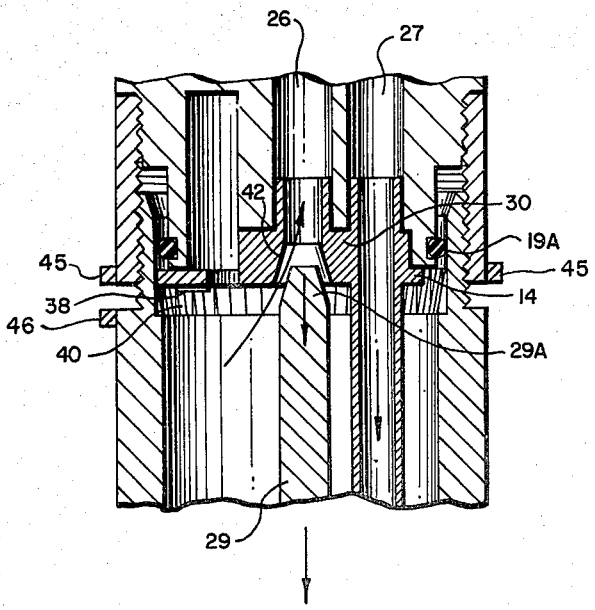
FIG. 6 is a fragmentary cross-sectional elevational view, on a further englarged scale, of the lower portion of the main body and the upper part of the oil container, to show operation of the valve.

As FIG. 1 is drawn, container 15 is fully threaded on to projection 19, and the tapered tip 29A of valve stem 29 is fully seated in valve seat 42 formed in the body 30 of insert 14. The unit is thus in its "off" position in FIG. 1. In FIG. 6, container 15 has been backed off or unthreaded a slight distance from its FIG. 1 position. Because of the presence of O-ring 19A, and the shallow pitch and numerousness of the threads connecting the container to the main body, no leakage results from this backing off. The unthreading of container 15 shown in FIG. 6 unseats tapered tip 29A of the valve stem from seat 42 somewhat. Because of the shallow pitch of the container threads and the deep pitch of the valve seat and tapered tip of the valve stem, very close control of the area of the valve opening is obtained. With the "clicking" feature discussed above and with indicia on the outside of the container and projection 19, it is easy to repeatedly obtain the desired valve opening area which results in a desired dispensing time.

Figure 5:
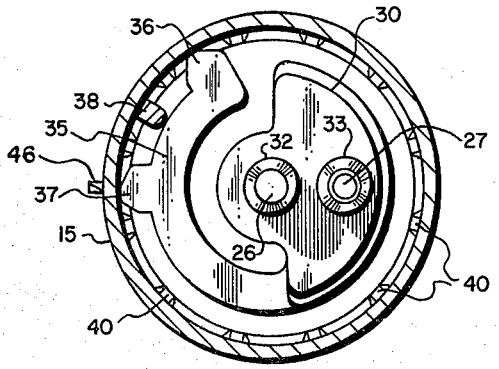
FIG. 5 is a plan view of the insert combined with a cross-sectional view of the oil container taken in the region of its detent serrations to show the interaction between these parts.

The above mentioned indicia are shown in FIGS. 5 and 6, but not in other FIGS., in the form of alignable indicia projections 45, on the fitting means 28 of body member 13, and indicia projection 46 on container 15. A plurality of projections 45 are distributed around fitting means 28, while a single projection 46 is provided on container 15. The position of indicia projection 46 with respect to indicia projections 45 indicates the relative angular position of the container with respect to the body member, and the degree of closure of the valve member against the seat.

With the valve open, as in FIG. 6, water can flow down bore 27, pick up (or force ahead of it) oil in container 15, flow through the open valve into bore 26 and rejoin the main water stream at the crest of dam 20.

In operation, water flowing through the main bore 16 is at a higher pressure at the point of interception of bore 27 with the main bore than it is at the point of interception of bore 26 with the main bore because of the constricted flow area at the dam. Water will accordingly flow downwardly through bore 27 into container 15, where it will pick up oil. The mixture will then flow up bore 26 and into the axial main bore at the crest of dam 20. The oil will be further mixed with flowing water between the dam and the shower head. The action just described continues until the oil supply is exhausted, or the dispenser is turned off.

The unit may be flushed to prevent oil build-up in the apertures and bores merely by running the shower for a time with the dispenser on after the oil supply has been exhausted. In addition, the shower nozzle may be turned off and the oil container removed, in which case bore 26 will be back-flushed. This action may be intensified by blocking bore 27 with a finger.

We claim:

1. A shower head dispenser for bath oil or the like comprising:

a body member having an axial bore therethrough, said body member being adapted for insertion in a shower system between a shower line and a shower head;

a constriction in said bore;

a first transverse bore in said body member extending from said constriction to a point on the exterior of said body member;

a valve seat formed at the exterior end of said first transverse bore;

a second transverse bore in said body member extending from a point in said axial bore upstream from said constriction to a point on the exterior of said body member;

fitting means on said body member encircling the exterior ends of said bores; and an oil container detachably engaged with said fitting means, said container carrying a valve member movable toward engagement with said valve seat upon movement of said container toward attachment and away from said valve seat upon movement of said container toward detachment.

2. A shower head dispenser in accordance with claim 1 in which said constriction comprises a dam extending transversely across said axial bore.

3. A shower head dispenser in accordance with claim 2 in which said first transverse bore extends from the crest of said dam to a point on the exterior of said body member.

4. A shower head dispenser in accordance with claims 2 or 3 in which said dam has a drainage opening therein.

5. A shower head dispenser in accordance with claim 2 in which said dam comprises a transverse column, wing walls extending from said column to the wall of said axial bore, a crest flange extending upstream in said bore, and drainage apertures beneath said wing walls.

6. A shower head dispenser in accordance with claim 1 in which said fitting means are threaded, and said oil container is threaded for engagement with said fitting means upon rotation with respect thereto.

7. A shower head dispenser in accordance with claim 6 in which said first transverse bore is positioned substantially on the axis of said fitting means, and said valve member is positioned axially of said container.

8. A shower head dispenser in accordance with claim 7 in which said valve member is a needle valve stem.

9. A shower head dispenser in accordance with claim 8 in which said valve stem is formed integrally with said container.

10. A shower head dispenser in accordance with claim 6 in which said oil container is provided with a set of detents extending circumferentially therearound, and said body member carries a detent spring engagable with said detents.

11. A shower head dispenser in accordance with claim 10 in which said detents are positioned on the interior wall of said container and said container encloses said detent spring.

12. A shower head dispenser in accordance with claim 10 or 11 in which said detents are positioned adjacent the upper edge of said container.

13. A shower head dispenser in accordance with claim 11 in which said detent spring is arcuate and has a pair of arcuately spaced detent engaging tabs thereon.

14. A shower head dispenser in accordance with claim 13 and further comprising a projection on said body member extending between said container inner wall and said spring between said tabs.

15. A shower head dispenser in accordance with claim 11 in which said valve seat and said detent spring are located on an insert attached to said body member.

16. A shower head dispenser in accordance with claim 15 in which said insert is formed of nylon.

17. A shower head dispenser in accordance with claims 6 or 10 in which alignable indicia are provided on said body member and said container to indicate the relative angular position of said container with respect to said body member and the degree of closure of said valve member against said seat.

* * * * *